United States Patent [19]

Schäfer

[11] Patent Number: 4,848,578

[45] Date of Patent: Jul. 18, 1989

[54] STORAGE AND/OR TRANSPORT CONTAINER OF PLASTICS MATERIAL

[75] Inventor: Gerhard Schäfer, Neunkirchen-Salchendorf, Fed. Rep. of Germany

[73] Assignee: Fritz-Schäfer Gesellschaft mit beschränkter Haftung, Fed. Rep. of Germany

[21] Appl. No.: 203,236

[22] Filed: Jun. 6, 1988

[30] Foreign Application Priority Data

Jun. 5, 1987 [DE] Fed. Rep. of Germany ... 870800[U]

[51] Int. Cl.[4] ..... B65D 21/06

[52] U.S. Cl. ..... 206/506

[58] Field of Search ..... 206/506

[56] References Cited

U.S. PATENT DOCUMENTS

| | | | |
|---|---|---|---|
| 4,109,791 | 8/1978 | Clipson | 206/506 |
| 4,247,004 | 1/1981 | Bird | 206/506 |
| 4,423,813 | 1/1984 | Kreeger | 206/506 |
| 4,466,541 | 8/1984 | Tabler | 206/506 |

*Primary Examiner*—George E. Lowrance
*Attorney, Agent, or Firm*—Toren, McGeady & Associates

[57] ABSTRACT

A storage and/or transport container of plastics material with a rectangular bottom and longitudinal and transverse side walls extending upwardly from the rectangular bottom. The upper edges of the side walls define a rectangular opening having a size greater than the rectangular bottom. Two support members are hinged to the container adjacent the upper edges of the transverse side walls. The support members can be swung from a first position in which they leave the rectangular opening clear to the transverse side walls into a second position in which they are located in the rectangular opening adjacent the transverse side walls so as to partially bridge the openings. In the second position, the distance between the sides of the support members facing each other is smaller than the width of the container bottom the two transverse side walls. The ends of the support members have support walls which extend transversely of the longitudinal direction of the support members. The support walls are pivotably mounted on support blocks which are arranged remote from the container corners on the upper edges of the longitudinal side walls. In the first position, each support member is received and supported in a groove-like upwardly open rim portion of the upper edge of each transverse side wall. In the second position, the ends and the support walls of each support member are received and supported in troughs which are open towards the top and toward the container interior and are formed in the upper edges of the longitudinal side walls.

12 Claims, 4 Drawing Sheets

STORAGE AND/OR TRANSPORT CONTAINER OF PLASTICS MATERIAL

BACKGROUND OF THE INVENTION

1. Field of the Invention

The present invention relates to a storage and/or transport container of plastics material. The container has a rectangular bottom and two longitudinal side walls and two transverse side walls extending upwardly from the rectangular bottom. The upper edges of the side walls define a rectangular opening having a size greater than the rectangular bottom. Two support or beam members are hinged to the container adjacent the upper edges of the transverse side walls. The support members can be swung from a position in which they leave the rectangular opening clear up to the transverse side walls into a position in which they are located in the rectangular opening adjacent to the transverse side walls so as to partially bridge the opening. In the second position, the distance between the sides of the support members facing each other is smaller than the width of the container bottom between the two transverse side walls.

2. Description of the Prior Art

Storage and/or transport containers of the above-described type are known. These containers are used when it is desired to stack unfilled or empty storage and/or transport containers in as space saving a manner as possible, while they can also be stacked in a safe and stable manner when they are filled with goods.

In the first situation, the support members which are hinged on are swung into the position in which they leave the rectangular opening clear up to the transverse side walls. In the second situation, the support members are swung into the position in which they partially bridge the rectangular opening adjacent the transverse side walls. In the latter case, the support members form a stable support for stacking another storage and/or transport container thereon.

Storage and/or transport containers of the above-described type in which not only the container itself but also the hinged support members are molded articles of plastics material, particularly polypropylene, have already been in use for a considerable time in Great Britain and Canada.

However, these known storage and/or transport containers have the disadvantage that the hinged support members are completely exposed on the outer side of the transverse side walls when they are in the position in which they leave the rectangular container opening clear up to the transverse side walls, while the support members rest on the upper edges of the side walls also completely exposed in the position in which they partially bridge the container opening.

The known arrangement of the hinged support members has the additional disadvantage that the storage and/or transport containers of plastics material must have corner regions with sharp edges and, therefore, are not very suitable for being used dynamically on transport and conveying units, because the corner regions with sharp edges of successive storage and/or transport containers tend to hook together in curved and on inclined portions of the conveying systems, so that the further transport of the containers is endangered or impaired.

It is, therefore, the primary object of the present invention to improve a storage and/or transport container of the above-described type. Specifically, the hinged support members are to be placed in a protected manner within the given container contours in both possible positions of the support members. In addition, it should be possible to use the hinged support members in storage and/or transport containers which have rounded-off corner regions at least in the wall portions thereof adjacent the rectangular openings.

SUMMARY OF THE INVENTION

In accordance with the present invention, the hinged support members have at the ends thereof support walls which extend transversely of the longitudinal direction of the support members. The support walls are pivotably mounted on support blocks which are arranged remote from the container corners on the upper edges of the longitudinal side walls. In the position swung away from the container opening, each support member is received and supported in a groove-like upwardly open rim portion of the upper edges of the transverse side walls. In the position swung into the container opening, the ends and the support walls of each support member are received and supported in troughs which are open toward the top and toward the container interior and are formed in the upper edges of the longitudinal side walls.

The storage and/or transport container according to the present invention has the advantage that the support members are mounted in a stable manner and are well protected toward the outside.

In accordance with another feature of the present invention, the support members have rounded-off portions in the transition areas thereof toward the support walls. In the position of the support members swung out of the container opening, the rounded-off portions are located adjacent corresponding rounded-off portions of the upwardly open rim portions at the container corners. Thus, the stirrup-like shape of the support members makes possible an optimum adjustment of the support members to the given requirements.

In accordance with a further development of the storage and/or transport container according to the present invention, the support members have a step-like cross-sectional shape which is stabilized by integrally formed transverse ribs and/or webs. Each support member additionally includes a longitudinal channel which is capable of receiving a stiffening rod, a stiffening tube, or a stiffening section. Thus, particularly if the container is to be used for receiving heavy goods, the hinged support members can be substantially stabilized and strengthened with simple manipulations.

In accordance with another advantageous feature of the invention, the support walls of the support members each have two parallel wall members between which the support blocks mounted at the upper edges of the container can be inserted.

Another feature of the present invention provides that a support axle is mounted between the wall members of the support walls, the support axle being placeable in a support trough of the bearing blocks and being fixable in this position by means of support stirrups engaging over the support axle.

Each support stirrup may also be a locking stirrup with locking projections or cams which may engage in locking openings provided in the rim portions of the upper edges of the containers.

In accordance with another feature of the present invention, the support members have alignment stops which, in the position of the support members swung into the container opening, receive the corners of the container bottom of the container stacked on top, so that stacked storage and/or transport containers are fixed in their position.

The alignment stops may be provided extending upwardly at the ends of a recessed step of the step-like sectional shape of the support member.

In accordance with a particularly advantageous feature of the storage and/or transport container of the present invention, each upwardly directed rim portion defines a stiffening member which in at least its middle portion forms an approximately U-shaped bed for the support members.

For stabilizing the stiffening member, the U-shaped bed may be stiffened by means of transverse webs and/or connecting webs.

The usefulness of the storage and/or transport container according to the present invention is further improved if a web of the stiffening member extending downwardly from the U-shaped bed has a cutout and the transverse side wall has a corresponding cutout, so that it is possible to grasp the bed region through the stiffening member and the side wall.

Finally, according to another advantageous feature, the support member has at the free end thereof in transverse direction a bead-like thickening which forms a handle for the support member located at a distance above the U-shaped bed in the position of the support member swung out of the container opening.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE INVENTION

Figure 1:
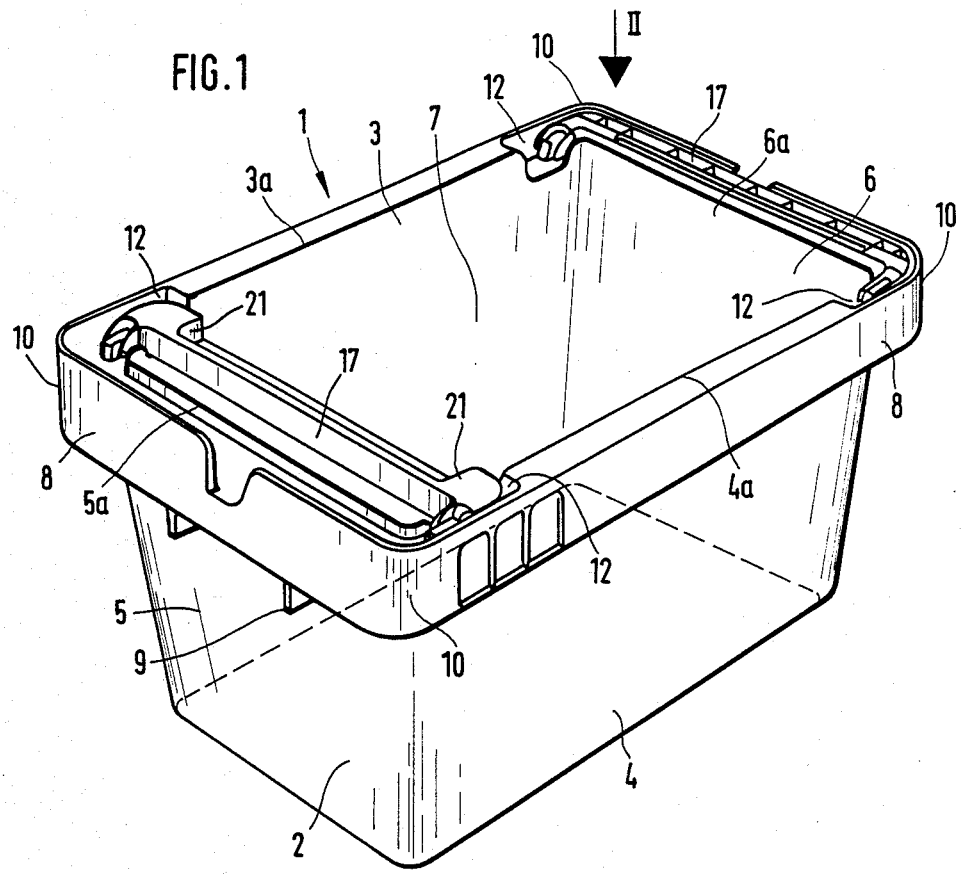
FIG. 1 is a perspective view of a storage and/or transport container of plastics material according to the present invention with hinged support members mounted parallel to the transverse side walls of the container in the region of the rectangular opening thereof.

The storage and/or transport container 1 illustrated in the drawing is made of plastics material in a single piece, for example, by injection molding in an appropriate mold. The container has an essentially plane and rectangular bottom 2. Two upwardly extending longitudinal side walls 3 and 4 and two upwardly extending transverse side walls 5 and 6 are attached to the bottom 2. The side walls define with the upper edges 3*a*, 4*a*, 5*a* and 6*a* a rectangular opening 7 which is larger in area than the bottom 2. Thus, the longitudinal side walls 3 and 4 as well as the transverse side walls 5 and 6 have an upwardly and outwardly inclined position starting from bottom 2. A stiffening member 8 is formed integrally to the outside of the container 1 in the region of the upper edges 3*a*, 4*a*, 5*a*, 6*a* of the longitudinal side walls 3 and 4 and the transverse side walls 5 and 6. As shown in FIG. 1 in the area of the transverse side walls 5, the stiffening member 8 may be stiffened in the conventional manner by ribs or webs 9 extending against the outer sides of the longitudinal side walls 3 and 4 and the transverse side walls 5 and 6.

Figure 6:
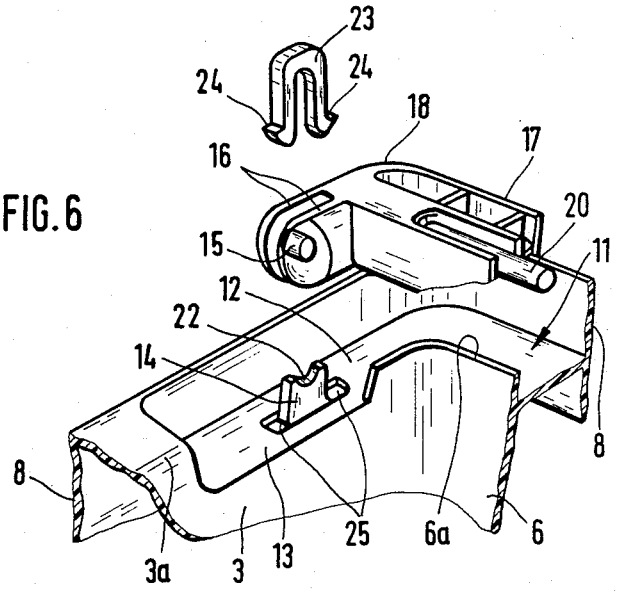
FIG. 6 is an exploded perspective view of a detail of the corner region identified with arrow II in FIG. 1.
Figure 4:
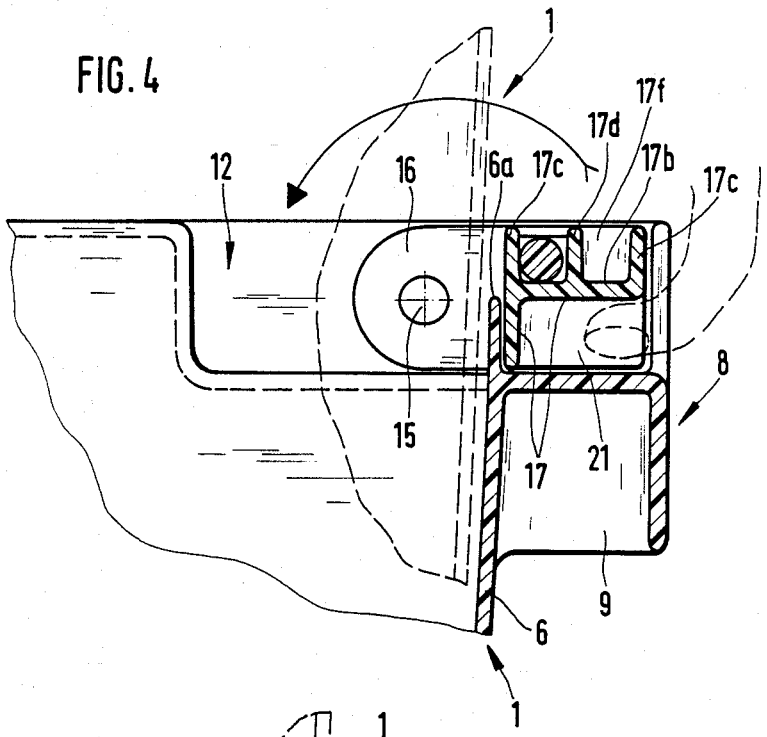
FIG. 4 is a sectional view taken along sectional line IV—IV of FIG. 2.
Figure 5:
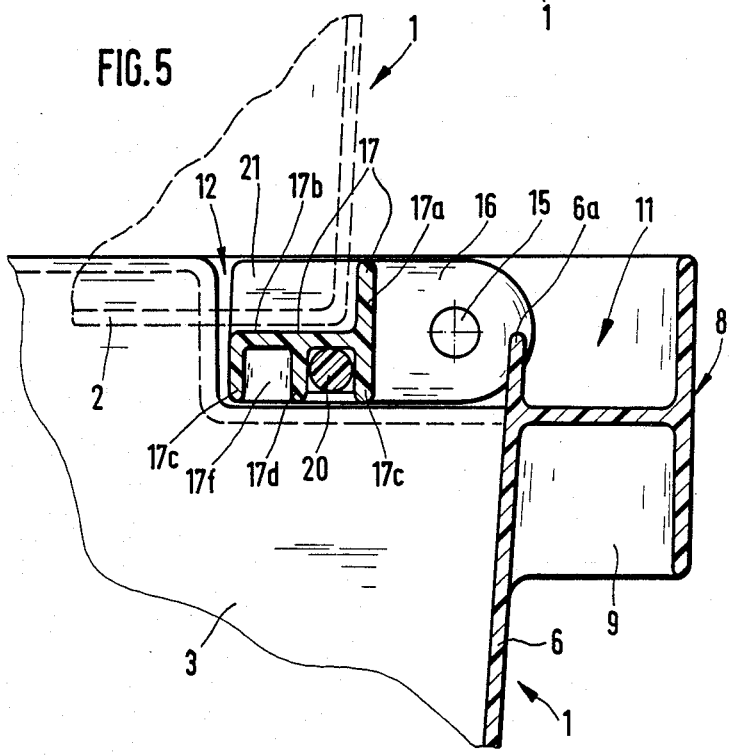
FIG. 5 is a sectional view taken along sectional line V—V of FIG. 3.

In the areas of the transverse side walls 5 and 6, the stiffening member 8 forms together with the upper portions of the transverse side walls 5 and 6 an approximately H-shaped cross-section, as can be seen particularly in FIGS. 4 to 6.

This approximately H-shaped cross-section extends also around the corner region 10 of the stiffening member 8 partially into the region of the two longitudinal side walls 3 and 4, as can also be seen in the drawing.

The stiffening member 8 forms over the entire width of the transverse side walls 5 and 6 a groove-like upwardly open rim portion 11, as can be seen particularly in FIGS. 5 and 6. This upwardly open rim portion 11 of the stiffening member 8 extends past the corner regions 10 of the stiffening member 8 to the adjacent longitudinal side walls 3 and 4 and forms in the longitudinal side walls 3 and 4 a trough 12 each which has an opening 13 which is open toward the interior of the container and extends to the bottom of the trough 12.

Adjacent the trough 12, the stiffening member 8 has along the longitudinal side walls 3 and 4 a downwardly open U-shaped cross-section.

Figure 2:
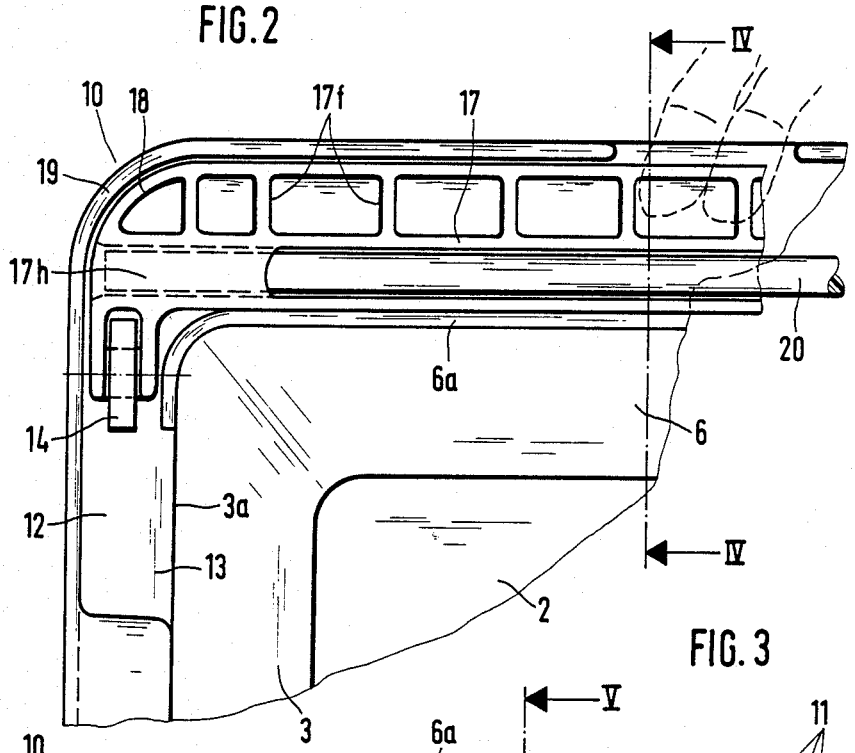
FIG. 2 is a partial top view, on a larger scale, of the corner region of the container of FIG. 1 seen in direction of arrow II of FIG. 1, with the hinged support member being swung into a first position.
Figure 3:
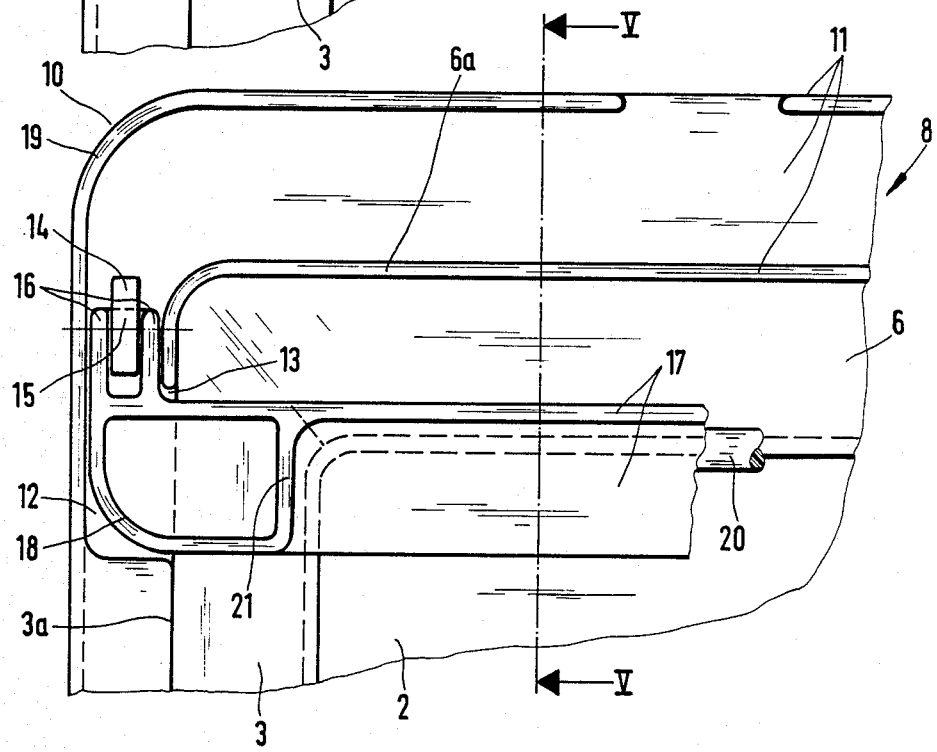
FIG. 3 is a partial top view, on a larger scale, of the corner region of the container of FIG. 1 seen in direction of arrow II of FIG. 1, with the hinged support member being swung into a second position.

Extending upwardly from the bottom of each trough 12 is a support block 14, as can be seen in FIGS. 2, 3 and 6. The support blocks 14 are arranged in the trough 12 in such a way that they are slightly recessed relative to a plane coinciding with the upper edges 5*a* and 6*a* of the transverse side walls 5 and 6. Fork-like support walls 16 engage with support axles 15 each support block 14. The support walls 16 are provided at the ends of the support members 17 and extend essentially transversely of the longitudinal direction of the support member, as can be seen particularly clearly in FIGS. 2, 3 and 6.

As shown in FIGS. 1 and 2 to 5, the support member 17 can be swung into two different positions relative to the storage and/or transport container 1 by means of the support blocks 14, the support axles 15 and the support walls 16. In a first position, illustrated in the right half of FIG. 1 and in FIGS. 2 and 4, the support member 17 is completely received by the groove-like upwardly open rim portion 11 of the stiffening member 8, so that the opening 7 of the storage and/or transport container 1 is completely clear up to the transverse side walls 5 and 6. In this first position of the support members 17, it is possible to stack a plurality of empty similar storage and/or transport containers 1 one within the other, as indicated in FIG. 4 of the drawing.

On the other hand, when the support members 17 are swung with the support wall 16 and the support axle 15 in the support blocks 14 by 180°, the support members 17 are swung into the second position shown in the left half of FIG. 1 and in FIGS. 3 and 5. In this second position, the support members 17 partially bridge the opening 7 of the support and/or transport container 1 adjacent the transverse side walls 5 and 6.

In the second position, the support members 17 rest supported on the bottom of the trough 12 with the support walls 16 and the end portions adjacent the support walls 16, as seen in FIG. 5, while the support members 17 extend through the openings 13 of the trough 12 and across the opening 7 at a distance from the transverse side walls 5 and 6. When both support members 17 are in the second position, the longitudinal edges thereof which face each other are spaced apart by a distance which is smaller than the width of the container bottom 2 between the corresponding transverse side walls 5 and 6. As FIG. 5 clearly shows, it is then possible to stack several filled storage and/or transport containers 1 in a safely aligned manner.

When in the second position, the support members 17 are located completely below the upper edge of the stiffening member 8 and, thus, are always protected against outside influences.

Due to the particularly advantageous placement of the support member 17 in the stiffening members 8, it is possible to provide the ends of the support members 17 in the transition areas thereof toward the support wall 16 with rounded-off portions 18. Since, in the first position of the support member 17, the rounded-off portions 18 of the support member 17 are located adjacent the corner portions 10 of the stiffening members 8, it is easily possible to make the corner portions 10 of the stiffening member 8 also in the form of rounded-off portions 19. As a result, when used on transport and/or conveying units, the capability of the storage and/or transport containers 1 of traveling through curves and inclinations is improved.

It is particularly clear from FIGS. 4 and 5 of the drawing that the support members 7 have a stepped cross-section with several sectional webs 17*a*, 17*b*, 17*c*, 17*d* and 17*e*. The sectional webs 17*a*, 17*e* and 17*c*, 17*d* extend essentially parallel to each other while the sectional web 17*b* extends transversely thereof. The sectional web 17*e* is located on the same plane as sectional web 17*a*, while the sectional webs 17*c* and 17*d* are connected essentially at a right angle to the sectional web 17*b*. The two sectional webs 17*c* and 17*d* of the support members 17 are connected to each other by means of transverse ribs 17*f*. A longitudinal channel is left free between the sectional webs 17*b*, 17*d* and 17*e*, the longitudinal channel only being closed by means of a web 17*h* at the ends of the channel. A stiffening section, such as, a tube or a rod, may be inserted as necessary in this longitudinal channel, as indicated in FIGS. 2 to 5 of the drawing. If necessary, this stiffening section 20 can be used to substantially increase the strength of the support member 17.

On a side adjacent the sectional web 17*a*, the sectional web 17*b* of support member 17 is provided near the two ends of the support members 17 with an alignment stop 21 each which extends upwardly approximately over the entire height of the sectional web 17*a*, as seen in FIGS. 1 and 3 to 5. These alignment stops 21 interact with the corners of a storage and/or transport container 1 immediately above the bottom 2 thereof, when such a container 1 has been placed from the top onto the support member 17. Thus, the alignment stops 21 and the sectional web 17*a* of each support member 17 provide a secure centering of the stacked storage and/or transport containers 1.

As FIG. 6 of the drawing further shows, the support axle 15 can be molded in one piece between the two parallel wall members of the support walls if the support block 14 is provided with an upwardly open support trough 22 into which the support axle 15 can be placed. In that case, each support block 14 is completed by means of a support stirrup 23 which can be inserted from the top between the two wall members of the support wall 16 over the support axle 15 and the support block 14. The support stirrup 23 is constructed as a locking stirrup with locking projections or cams 24 which can be inserted in locking openings provided in the bottom of the trough 12 or in the wall portion of the stiffening member 8 forming the bottom of the trough 12.

Figure 7:
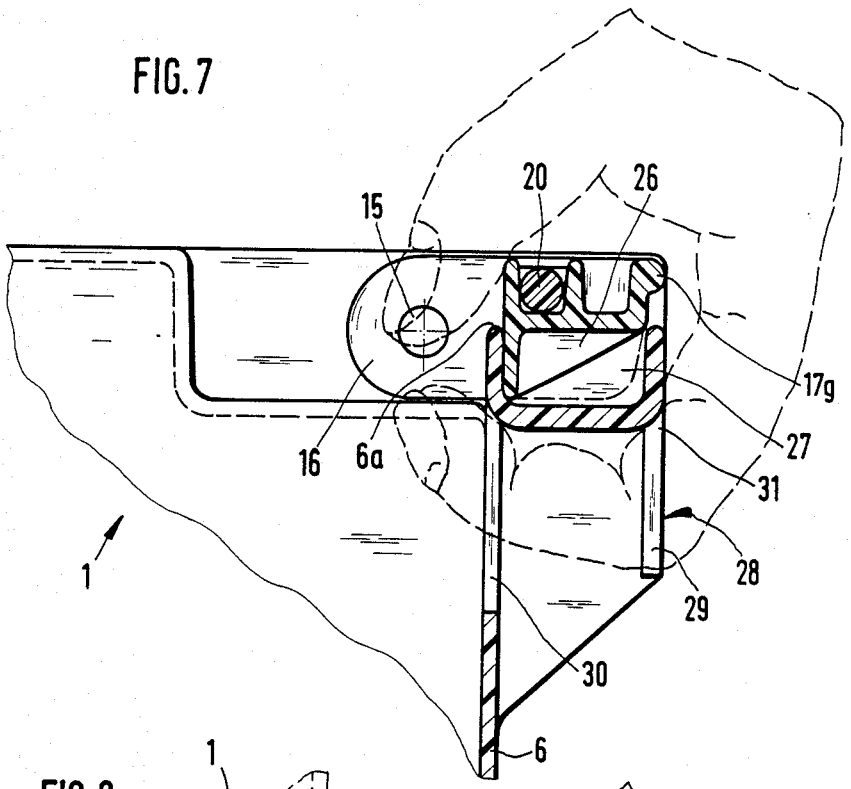
FIG. 7 is a sectional view, corresponding to the view of FIG. 4, of another embodiment of the storage and/or transport container according to the present invention.
Figure 8:
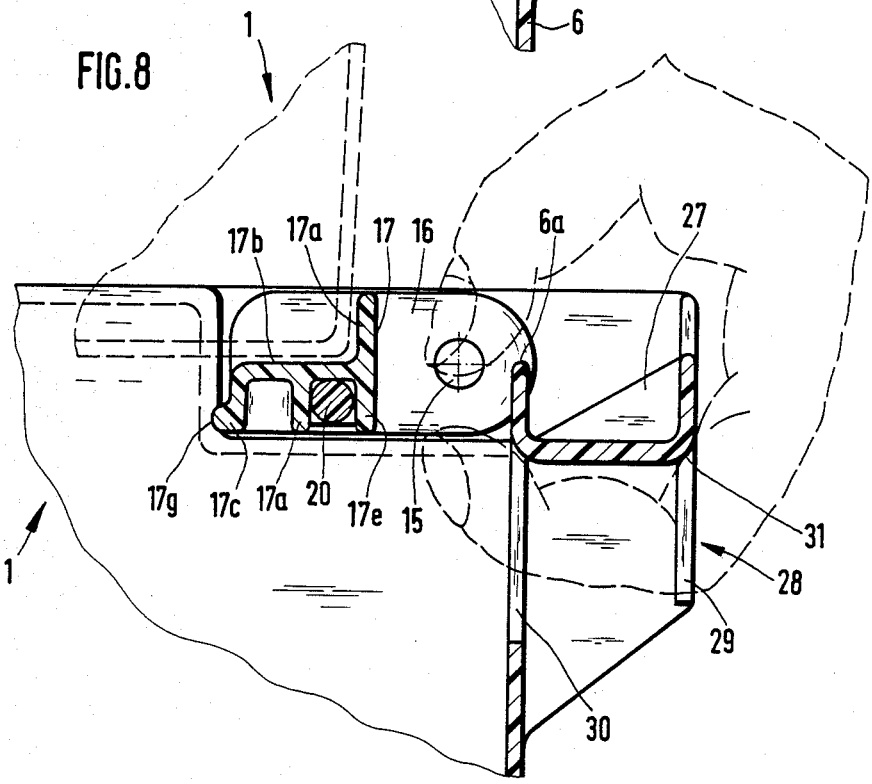
FIG. 8 is a sectional view, corresponding to the view of FIG. 5, of another embodiment of the storage and/or transport container according to the present invention.

As can be seen in FIGS. 7 and 8 of the drawing, the construction of the stiffening member 8 in the region of the transverse side walls 5 and 6 as well as the construction of the corresponding support member 17 can be advantageously varied compared to the construction illustrated in FIGS. 4 and 5.

In the embodiment according to FIGS. 7 and 8, the stiffening member 8 also has an essentially H-shaped cross-section in the region of the transverse side walls 5 and 6.

However, approximately in the middle of the transverse side walls 5 and 6 and extending at least along a length of the width of a hand, the groove-like upwardly open rim portion of the stiffening member 8 is constructed as an approximately U-shaped sectional bed 26 whose sectional height ends underneath the upper limiting plane of the stiffening member 8, as can be seen clearly in FIGS. 7 and 8. The total sectional height of the U-shaped bed 26 ends approximately on the same level 5*a* and 6*a* of the transverse side walls 5 and 6.

The groove-like outwardly open rim portion 11 of the stiffening member 8 is stabilized within the bed 26 by means of transverse webs and/or connecting webs 27, as also clearly shown in FIGS. 7 and 8.

While the sectional height of the upwardly open rim portion 11 of the stiffening member 8 is such that it can receive the full sectional height of the support member 17 when the support member 17 is in the first position, as seen in FIG. 7, the bed 26 only has a sectional height which is suitable for receiving the sectional web 17*a* of the support member 17. The sectional webs 17*c* and 17*d* as well as the sectional web 17*b*, on the other hand, are then located above the bed 26, as also shown in FIG. 7.

A downwardly extending web 28 has a cutout 29 along the longitudinal extension thereof. The width of the cutout 29 is at least that of the width of a hand. Corresponding to the cutout 29, a cutout 30 is provided in each transverse side wall 5 and 6, so that the U-shaped bed 26 forms a gripping member 31 in the region of the cutout 29 and 30 which can be securely grasped with a hand toward the interior of the storage and/or transport container 1, as illustrated in FIGS. 7 and 8.

The gripping members 31 not only make it possible to more easily and safely manipulate individual storage and/or transport containers 1, the manipulation of stacks of containers is also facilitated, i.e., when several similar storage and/or transport containers 1 are stacked in the filled state, as indicated in FIG. 8.

In order not to impair the manipulation of the support member 17 between the first position thereof illustrated in FIG. 7 and the second position thereof illustrated in FIG. 8, the outer sectional web 17*c* has at the free longitudinal edge thereof a bead-like thickening 17*g*. When the support member 17 is in the first position, the bead-like thickening 17*g* is spaced at such a distance above the U-shaped bed 26, that it can be easily grasped and, thus, forms a handle for the support member 17. If a storage and/or transport container 1 is carried with the support member 17 in the first position by grasping the gripping member 31, the support members 17 are also grasped and, thus, an additional stiffening and, thus, an increased stability in the region of the gripping member 31 is obtained.

While a specific embodiment of the invention has been shown and described in detail to illustrate the application of the inventive principles, it will be understood that the invention may be embodied otherwise without departing from such principles.

I claim:

1. In a storage and/or transport container of plastics material, the container having a rectangular bottom and two longitudinal side walls and two transverse side walls connected at corners of the container and extending upwardly from the rectangular bottom, the side walls having upper edges defining a rectangular opening having a size greater than the rectangular bottom, two support members being hinged to the container adjacent the upper edges of the transverse side walls, the support members being swingable from a first position in which they leave the rectangular opening clear up to the transverse side walls into a second position in which they are located in the rectangular opening adjacent the transverse side walls so as to partially bridge the opening, wherein, when the support members are in the second position, the distance between sides of the support members facing each other is smaller than the width of the container bottom between the two transverse side walls, each support member having a longitudinal direction and two ends, the improvement comprising the hinged support members having at the ends thereof support walls which extend transversely of the longitudinal direction of the support members, support blocks being arranged remote from the container corners on the upper edges of the longitudinal side walls, the support walls being pivotably mounted on the support blocks, a groove-like upwardly open rim portion being formed on the upper edge of each transverse side wall, the support member being received and supported in the upwardly open rim portion when the support member is in the first position, troughs which are open toward the top and toward the container interior being formed in the upper edges of the longitudinal side walls, the ends and the support walls of each support member being received and supported in the troughs when the support member is in the second position.

2. The container according to claim 1, wherein the support members have rounded-off portions in transition areas thereof toward the support walls, the rounded-off portions being located adjacent corresponding rounded-off portions of the upwardly open rim portions at the container corners when the support members is in the first position.

3. The container according to claim 1, wherein the support members have a step-like cross-sectional shape, the support members being stabilized by integrally formed transverse ribs, each support member additionally including a longitudinal channel for receiving a stiffening rod, a stiffening tube or a stiffening section.

4. The container according to claim 1, wherein each support wall of the support members have two parallel wall members, the support blocks mounted at the upper edges of the container being insertable between the wall members.

5. The container according to claim 4, wherein a support axle is mounted between the wall members of each support wall, each bearing block defining a support trough, the support axle being placeable in the support trough and being fixable thereon by means of a support stirrup engaging over the support axle.

6. The container according to claim 5, wherein each support stirrup is a locking stirrup having locking projections, the locking projections being engageable in locking openings defined in the rim portions of the upper edges of the side walls.

7. The container according to claim 3, wherein the support members having alignment stops which, when the support member is in the second position, receive the corners of the bottom of a container stacked on top of the support members.

8. The container according to claim 7, wherein the alignment stops are formed extending upwardly at the ends of a recessed step of the step-like sectional shape of the support member.

9. The container according to claim 1, wherein the upwardly directed rim portions of the transverse side walls define stiffening members which in at least the middle portions thereof form approximately U-shaped beds for the support members.

10. The container according to claim 9, wherein the U-shaped bed is provided with transverse webs and connecting webs.

11. The container according to claim 9, wherein a downwardly extending web is attached to the U-shaped bed, the downwardly extending web and the transverse side wall having corresponding cutouts so to enable grasping the bed region through the stiffening member and the side wall.

12. The container according to claim 9, wherein each support member has at a free end thereof in transverse direction a bead-like thickening forming a handle for the support member which is located at a distance above the U-shaped bed when the support member is in the first position.

* * * * *